United States Patent [19]

Hoshino et al.

[11] Patent Number: 4,696,218

[45] Date of Patent: Sep. 29, 1987

[54] FASTENING MEANS FOR GUITAR STRINGS

[75] Inventors: Yoshihiro Hoshino, Nagoya; Kazuhiro Matsui, Aichi, both of Japan

[73] Assignee: Hoshino Gakki Co., Ltd., Japan

[21] Appl. No.: 904,278

[22] Filed: Sep. 8, 1986

[30] Foreign Application Priority Data

Dec. 13, 1985 [JP] Japan ..... 60-192393[U]

[51] Int. Cl.[4] ..... G10D 3/14

[52] U.S. Cl. ..... 84/297 R; 84/207; 84/312 R

[58] Field of Search ..... 84/207, 297 R, 297 S, 84/298, 299, 311, 312 R

[56] References Cited

U.S. PATENT DOCUMENTS 3,596,552 8/1971 Lager ..... 84/207

4,378,723 4/1983 Scholz ..... 84/297 R

*Primary Examiner*—Benjamin R. Fuller

*Attorney, Agent, or Firm*—Ostrolenk, Faber, Gerb & Soffen

[57] ABSTRACT

A guitar constructed for so-called "one-touch" tuning including a pivoted lever that is movable between string relaxing and string tensioning positions, and is held in the latter position by a releasable latch. The lever is secured to a string by a ball-like retaining member that is clamped to the string at a predetermined location near the tail end thereof. Preferably, this clamping takes place shortly prior to securing the string to the lever. The retaining member is provided with at least one groove through which the string extends. The retaining member is deformed by crushing same at portions thereof that defines at least one groove thereby collapsing the groove around the string to firmly clamp the retaining member to the string.

11 Claims, 8 Drawing Figures

FASTENING MEANS FOR GUITAR STRINGS

BACKGROUND OF THE INVENTION

This invention relates to stringed musical instruments in general and more particularly relates to means for securing the tail end of a string to a tensioning member.

In the prior art it is conventional for guitars, as for other stringed instruments, for each string to have its tail end fixed and to have its head end inserted into an adjusting screw, and adjusting sound by appropriately tightening such screw.

Recently, so-called "one-touch" tuning techniques have been proposed. In accordance with such techniques, balls are provided at both ends of a guitar string which has been cut to a prescribed length. The ball at the tail or rear end of the string is engaged by a lever that is operable to stretch the string to a required extent to achieve tuning, at which point a releasable latch engages the lever to hold it in this position. For this type of arrangement generally see copending U.S. patent application Ser. No. 830,068 filed Feb. 14, 1986 by Y. Hoshino and K. Matsui for Tailpiece of a Guitar, and assigned to the assignee of the instant invention.

According to this prior art technique, it was necessary to stock many strings of different lengths, the numbers depending upon how many tones were to be achieved and how many different instrument models were involved. This proved to be extremely costly.

SUMMARY OF THE INVENTION

In accordance with the instant invention, a limited number of string lengths are stocked and the balls are constructed so that they may readily be placed and secured at predetermined locations along the lengths of the string. In particular, each ball is provided with at least one string-holding groove. After the string is placed to extend through the groove and the ball is located appropriately with respect to string length, the ball is crushed in the region that defines the groove so that the latter collapses to firmly engage the string. For strings of large diameter, a single string holding groove is sufficient. For small diameter string, the ball is provided with two parallel grooves, the string is looped around the ball so that two thicknesses of string extend through at least one of the grooves. The ball is then crushed so that the region thereof defining the groove having the doubled string thickness is crushed to collapse this groove thereby firmly clamping the ball to the string.

Accordingly, the primary object of the instant invention is to provide a novel improved construction for so-called "one-touch" tuning type musical string instruments.

Another object of the present invention is to provide instruments of this type in which a retaining member or ball is secured to a string at the time the latter is to be installed.

Still another object of the present invention is to provide instruments of this type having a retaining member or ball that is readily secured to a string at a predetermined location thereof.

A further object of the present invention is to provide instruments of this type in which there is a retaining member that is crushable and is provided with at least one groove through which the string extends, with such groove being collapsed by crushing of the retaining member to firmly secure the latter to the string.

BRIEF DESCRIPTION OF THE DRAWINGS

These objects, as well as other objects of this invention shall become readily apparent after reading the following description of the accompanying drawings in which.

DESCRIPTION OF THE PREFERRED EMBODIMENTS

Figure 1:
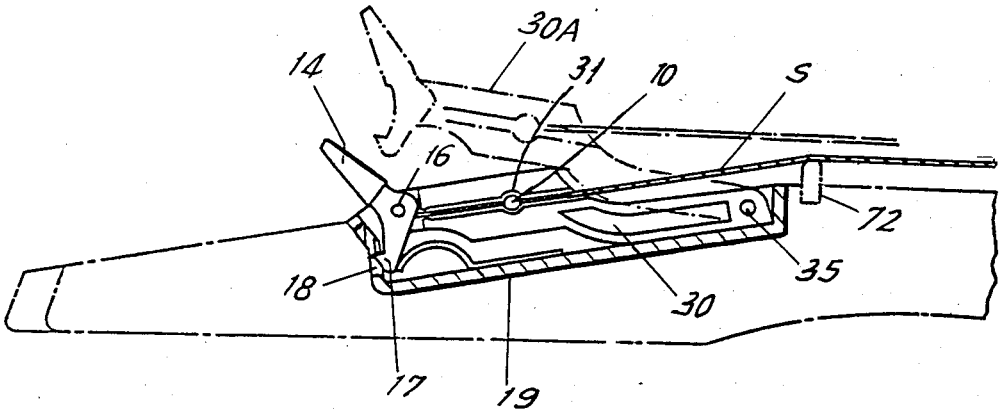
FIG. 1 is a fragmentary side elevation, partially sectioned, illustrating the tail section of a guitar constructed in accordance with teachings of the instant invention.
Figure 2:
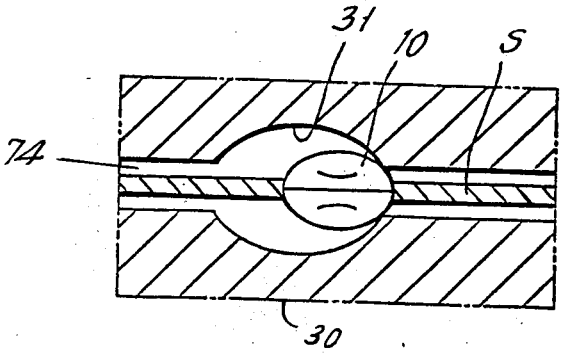
FIG. 2 is an enlarged fragmentary view illustrating the connection between a string and a pivoted string-stopping member.

Referring to the drawings, string stopping member or lever 30 is pivotally mounted to main body 19 on fixed pivot 35 that is disposed slightly to the rear and below the upper string supporting surface of saddle 72. Lever 30 is movable back and forth between the solid line string tensioning position of FIG. 1 and the string relaxing position 30A shown in phantom. Releasable latching member 14 is mounted to the rear end of string stopping member 30 on pivot 16. Latching tip 17 of latch 14 moves into cutout 18 of main body 19 to latch thereagainst and hold string stopping member 30 in its string tensioning solid line position whereat string S is stretched across the upper surface of saddle 72.

String S extends through longitudinal groove 74 that is open at the side of string stopping member 30. At a point intermediate its ends, groove 20 is enlarged to provide engaging recess 31 which receives ball-like retaining member 10 that is firmly secured to string S at a predetermined location therealong.

Figure 3:
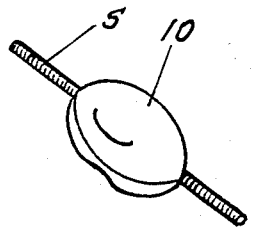
FIG. 3 is a perspective of a retaining member mounted to a string.
Figure 4:
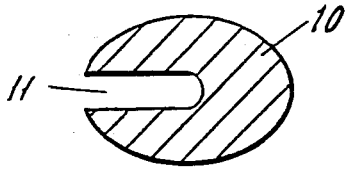
FIG. 4 is a transverse cross-section of the retaining member of FIG. 3 prior to mounting thereof.
Figure 5:
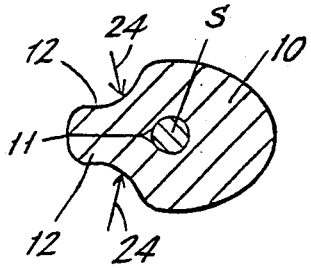
FIG. 5 is a transverse cross-section of the retaining member of FIG. 3 firmly secured to a string.

As seen best in FIGS. 3–5, retaining member 10 is provided with string holding groove 11 that extends from one side thereof to the center of member 10. String S is placed at the bottom of groove 11 and retaining member 10 is moved to a predetermined location along string S. Thereafter, retaining member 10 is crushed at portions 12, 12 thereof with a crimping tool (not shown) by applying force at the locations and in the directions indicated by arrows 24, 24, thereby collapsing groove 11 around string S so that retaining member 10 is firmly clamped around string S. Thereafter, retaining member 10 is inserted into recess 31 while string stopping member 30 is in its string relaxing position 30A. Thereafter, string stopping member 30 is pivoted counterclockwise with respect to FIG. 1 to the solid line string tensioning position. Those skilled in the art should recognize that the relative locations of recess 31, pivot 35 and the upper string supporting surface of saddle 72 results in a structure wherein string stopping member 30 operates in accordance with the so-called "rising lever" principle to achieve "one-touch" tuning.

Figure 6:
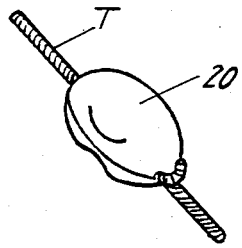
FIGS. 6, 7 and 8 are views corresponding to views of the respective FIGS. 3, 4 and 5, illustrating a second embodiment for a retaining member that is useful with relatively small diameter strings, whereas the retaining member of FIGS. 3, 4 and 5 is particularly useful with relatively large diameter strings.
Figure 7:
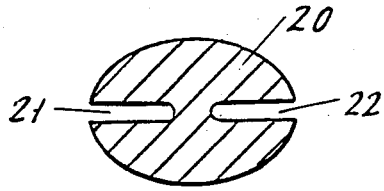
Figure 8:
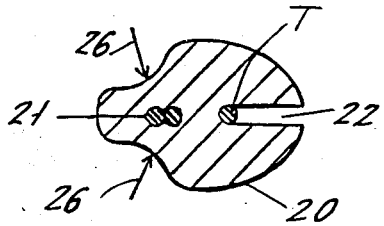

Retaining member 10 is of generally oval cross-section in a plane taken transverse to string S and is adapted for use with a relatively large diameter string S. Retaining member 20 of FIGS. 6–8 having two grooves is intended for use with relatively small diameter string T. String holding grooves 21, 22 of retaining member 20 are disposed in a common plane along the major diameter of the transverse cross-section. String T is looped around retaining member 20 with a double thickness of string T lying within groove 21 and a single thickness of string T lying within groove 22. Retaining member 20 is firmly clamped on string T by crushing thereof with force applied at the locations and in the directions indicated by arrows 26, 26, thereby collapsing groove 21. For additional holding force between member 20 and string T, groove 22 is also collapsed to clamp around string T.

Although the present invention has been described in connection with preferred embodiments thereof, many other variations and modifications will now become apparent to those skilled in the art without departing from the scope of the invention. It is preferred, therefore, that the present invention be limited not by the specific disclosures herein, but only by the appended claims.

What is claimed is:

1. A tailpiece section for a stringed musical instrument including:

a string stopping member;

a string;

a retaining member secured to said string at a predetermined location thereof in the vicinity of its tail end;

said stopping member including a holding formation for engaging said retaining member;

a saddle disposed at a position forward of said retaining member for supporting said string while it is in tension;

said stopping member being mounted for movement between a first position for string tensioning and a second position for string relaxation;

a releasable latch for retaining said stopping member in said first position;

said retaining member being deformed to lock same at said predetermined location.

2. A tailpiece section as in claim 1 in which the retaining member includes a groove through which said string extends, and deformation of said retaining member comprises crushing same at portions thereof defining said groove.

3. A tailpiece section as in claim 1 in which the retaining member includes first and second grooves through which said string extends, said string being looped around said retaining member so that a double thickness of said string extends through said first groove, and deformation of said retaining member comprises crushing same at portions thereof defining said first groove.

4. A tailpiece section as in claim 3 in which a single thickness of said string extends through said second groove.

5. A tailpiece section as in claim 1 in which the stopping member includes front and rear ends, a pivot mounting said stopping member at its said rear end; said saddle being forward of said pivot; and said holding formation being disposed between said front and rear ends.

6. A tailpiece section as in claim 2 in which the stopping member includes front and rear ends, a pivot mounting said stopping member at its said rear end; said saddle being forward of said pivot; and said holding formation being disposed between said front and rear ends.

7. A tailpiece section as in claim 3 in which the stopping member includes front and rear ends, a pivot mounting said stopping member at its said rear end; said saddle being forward of said pivot; and said holding formation being disposed between said front and rear ends.

8. A tailpiece section as in claim 3 in which the retaining member is ball-like.

9. A tailpiece as in claim 2 in which the retaining member in a plane at right angles to the length of said string is generally an oval, and the groove extends along the major axis of said oval.

10. A tailpiece as in claim 9 in which the string extends through the center of said oval.

11. A tailpiece as in claim 3 in which the retaining member in a plane at right angles to the length of said string is generally an oval; and the grooves lie in a common plane.

* * * * *